US009863686B2

(12) United States Patent
Park

(10) Patent No.: US 9,863,686 B2
(45) Date of Patent: Jan. 9, 2018

(54) ICE MAKER CAPABLE OF ADJUSTING FULL-ICE LEVEL, DEVICE AND METHOD FOR ADJUSTING FULL-ICE LEVEL

(71) Applicant: Dongbu Daewoo Electronics Corporation, Seoul (KR)

(72) Inventor: Won Gu Park, Seoul (KR)

(73) Assignee: Dongbu Daewoo Electronics Corporation, Seoul (KR)

( * ) Notice: Subject to any disclaimer, the term of this patent is extended or adjusted under 35 U.S.C. 154(b) by 107 days.

(21) Appl. No.: 14/825,075

(22) Filed: Aug. 12, 2015

(65) Prior Publication Data

US 2016/0370079 A1 Dec. 22, 2016

(30) Foreign Application Priority Data

Jun. 17, 2015 (KR) ..... 10-2015-0085772

(51) Int. Cl.
*F25C 5/18* (2006.01)
*F25D 29/00* (2006.01)
*F25D 11/00* (2006.01)

(52) U.S. Cl.
CPC ..... *F25C 5/187* (2013.01); *F25D 11/00* (2013.01); *F25D 29/005* (2013.01)

(58) Field of Classification Search
CPC ..... F25C 5/187; F25C 5/18; F25C 2700/00; F25C 2700/02; F25D 29/005; F25D 11/00; F25D 29/00
USPC ..... 62/137, 151; 250/238
See application file for complete search history.

(56) References Cited

U.S. PATENT DOCUMENTS 6,314,745 B1 * 11/2001 Janke ..... F25C 5/005 62/137
2005/0072167 A1 4/2005 Oh
2008/0157644 A1 7/2008 Lee et al.
2009/0013708 A1 * 1/2009 Truitt ..... F25D 23/126 62/264
2009/0126391 A1 * 5/2009 Heger ..... F25C 1/10 62/345
2009/0151795 A1 * 6/2009 Hsu ..... F25C 1/225 137/386
2009/0165471 A1 * 7/2009 Rafalovich ..... F25C 5/187 62/66
2009/0193824 A1 * 8/2009 Heger ..... F25C 1/10 62/126

(Continued)

FOREIGN PATENT DOCUMENTS

KR 2002-0012442 2/2002
KR 10-2005-0033754 A 4/2005

(Continued)

*Primary Examiner* — Mohammad M Ali

(57) ABSTRACT

A device for adjusting a full-ice level includes: an ice making tray for making ice; an ice making tray fixing unit positioned on both sides of the ice making tray to support the ice making tray; an ice storage unit positioned below the ice making tray and for storing ice that is separated from and drops from the ice making tray; a full-ice level sensor for sensing the highest level of ice stored in the ice storage unit; a sensor guide on which the full-ice level sensor is installed, and positioned in the ice storage unit; and a motor on one side of the ice making tray fixing unit and coupled with the sensor guide, and for moving the sensor guide upward and downward in the ice storage unit.

11 Claims, 5 Drawing Sheets

(56) References Cited

U.S. PATENT DOCUMENTS

2010/0257877 A1 10/2010 Yun et al.

FOREIGN PATENT DOCUMENTS

| | | |
|---|---|---|
| KR | 10-2008-0062190 | 7/2008 |
| KR | 10-2010-0064582 | 6/2010 |
| KR | 10-2010-0113936 | 10/2010 |
| KR | 10-2012-0060772 A | 6/2012 |

* cited by examiner

ICE MAKER CAPABLE OF ADJUSTING FULL-ICE LEVEL, DEVICE AND METHOD FOR ADJUSTING FULL-ICE LEVEL

RELATED APPLICATION

This application claims priority to Korean Patent Application No. 10-2015-0085772, filed Jun. 17, 2015, hereby incorporated by reference in its entirety.

TECHNICAL FIELD

Embodiments according to the present invention relate to refrigerators, and more particularly to an ice maker for refrigerators that is capable of adjusting a full-ice level, a device and a method for adjusting the full-ice level to adjust the amount of ice made and to reduce power consumed to make ice by reducing the amount of ice that is made depending on a user's inclinations and the circumstances, by allowing users to selectively adjust the position of a full-ice level sensor to adjust the amount of ice made depending on the season, for example, less ice may be made in the winter when there may be less need for ice or when users consume relatively less ice.

BACKGROUND

In general, a household refrigerator is an appliance with a given storage space for storing food at a lower temperature, consisting of a refrigerator compartment maintaining a temperature a few degrees above the freezing point of water and a freezer compartment maintaining a temperature below the freezing point of water. Recent higher demand for ice contributes to increasing demand for a refrigerator equipped with an ice maker that can automatically make ice.

The aforementioned ice maker may be installed in the freezer compartment depending on the type of a refrigerator, or in the refrigerator compartment if required.

FIG. 1 shows an example of an ice maker installed in the freezer compartment. The ice maker 100 has an ice storage unit 102 for storing ice as shown in FIG. 1, and the ice stored in the ice storage unit 102 may be dispensed to the outside through an ice dispenser unit in accordance with an external ice dispensing signal. In this case, if more ice than a given amount of ice is dispensed to the outside, information is provided as feedback to enable the ice maker 100 to make ice again, and the new ice may be introduced into the ice storage unit 102.

Meanwhile, the ice maker 100 may be equipped with a full-ice level sensor for measuring a full-ice level of ice stored in the ice storage unit 102. If the full-ice level sensor is implemented as an optical sensor, it is installed on the upper part of the ice storage unit 102 to sense the full-ice level when the ice storage unit 102 is full of ice and light to the optical sensor is thus blocked.

The measurement position of the aforementioned conventional full-ice level sensor, however, is fixed to the uppermost part of the ice storage unit 102 to let the ice maker 100 continue to produce ice until the level reaches the full-ice level. Therefore, for users who do not consume ice frequently or in winter, for example, when there may be less demand for ice, the maximum amount of ice continues to be made and this consumes power to make ice that is unnecessary.

SUMMARY

In view of the above, the present invention provides an ice maker for refrigerators capable of adjusting a full-ice level, a device and a method for adjusting the full-ice level to adjust the amount of ice made and to reduce power consumed to make ice by reducing the amount of ice that is made depending on a user's inclinations and the circumstances, by allowing users to selectively adjust the position of a full-ice level sensor to adjust the amount of ice made depending on the season, for example, less ice may be made in the winter when there may be less need for ice or when users consume relatively less ice.

In accordance with an embodiment of the present invention, there is provided a device for adjusting a full-ice level in an ice maker, the device including: an ice making tray for making ice; an ice making tray fixing unit positioned on both sides of the ice making tray that supports the ice making tray; an ice storage unit positioned below the ice making tray and for storing the ice that is separated from and drops from the ice making tray; a full-ice level sensor for sensing the highest level of ice stored in the ice storage unit; a sensor guide on which the full-ice level sensor is installed, and positioned in the ice storage unit; and a motor located on one side of the ice making tray fixing unit and coupled with the sensor guide, and for moving the sensor guide upward and downward in the ice storage unit.

Further, the sensor guide may be coupled with the motor through a guide gear located on one side of the sensor guide, and moves upward/downward in the ice storage unit by driving the guide gear upward/downward according to the rotation of the motor.

Further, the sensor guide may have a light emitting unit of the full-ice level sensor on one side and a light receiving unit of the full-ice level sensor on the other side, facing the light emitting unit.

Further, in an embodiment, the ice storage unit has a guide formed therein, the guide enabling the sensor guide to move upward/downward relative to the ice storage unit.

Further, in an embodiment, the guide is formed on two (e.g., opposite) sides of the ice storage unit.

In accordance with an embodiment of the present invention, there is provided an ice maker for adjusting a full-ice level, the ice maker including: an ice making unit that repeats the process of making and separating ice from an ice making tray; a full-ice level sensor for sensing the highest level of the ice in an ice storage unit; a sensor guide installed with the full-ice level sensor, and positioned in the ice storage unit; a motor coupled with the sensor guide using a gear structure, and for moving the sensor guide upward and downward in the ice storage unit according to the motor's rotation; and a control unit: for controlling the process of making ice until the level of ice reaches the highest level of ice in the ice storage unit, calculating the amount of motor rotation equivalent to a position adjustment for the full-ice level sensor in response to a position adjustment input, and driving the motor by the calculated amount of rotation to adjust the position of the full-ice level sensor.

Further, the motor may be formed on one side of an ice making tray fixing unit that supports the ice making tray, and moves the sensor guide upward and downward in the ice storage unit when it is driven by the control unit.

Further, the sensor guide may be coupled with the motor through a guide gear that converts rotational motion of the motor into upward/downward motion, and moves upward/downward in the ice storage unit when the motor rotates.

Further, the full-ice level sensor may use a light emitting unit and a light receiving unit installed on opposite sides of the sensor guide to sense the full-ice level when light emitted from the light emitting unit is not received by the light receiving unit.

In accordance with an embodiment of the present invention, there is provided a method for adjusting a full-ice level, the method including: entering a position adjustment value for a full-ice level sensor in an ice maker; calculating an amount of motor rotation for adjusting the position of a sensor guide equipped with the full-ice level sensor, the amount of motor rotation corresponding to the position adjustment value; rotating the motor by the calculated amount of rotation; transmitting the torque from the rotation of the motor to the sensor guide; and moving the sensor guide upward/downward in response to the rotation of the motor to adjust the position of the full-ice level sensor.

Further, the sensor guide may include a guide gear coupled with the motor, and the sensor guide is moved upward/downward in the ice storage unit by driving the guide gear according to the motor's rotation.

Further, the sensor guide may move upward/downward in the ice storage unit along a guide in the ice storage unit.

Further, the full-ice level sensor may use a light emitting unit and a light receiving unit installed on opposite sides of the sensor guide to sense the full-ice level when light emitted from the light emitting unit is not received by the light receiving unit.

Therefore, the ice maker for refrigerators in accordance with the present invention has advantages that allows users to adjust the amount of ice depending on user's inclinations and the circumstances and to reduce power consumed to make ice by reducing the amount of ice that is made, by allowing users to selectively adjust the position of the full-ice level sensor to adjust the amount of ice made depending on the season, for example, less ice may be made in the winter when there may be less demand for ice or when users consume relatively less ice.

DETAILED DESCRIPTION

Hereinafter, the operational principles of the present invention will be described in detail with reference to the accompanying drawings. In the following description, well-known functions and/or constitutions will not be described in detail if they would unnecessarily obscure the features of the present invention. Further, the terms to be described below are defined in consideration of their functions in the embodiments of the present invention and may vary depending on a user's or operator's intention or practice. Accordingly, the definition may be made on a basis of the content throughout the disclosure.

Figure 2:
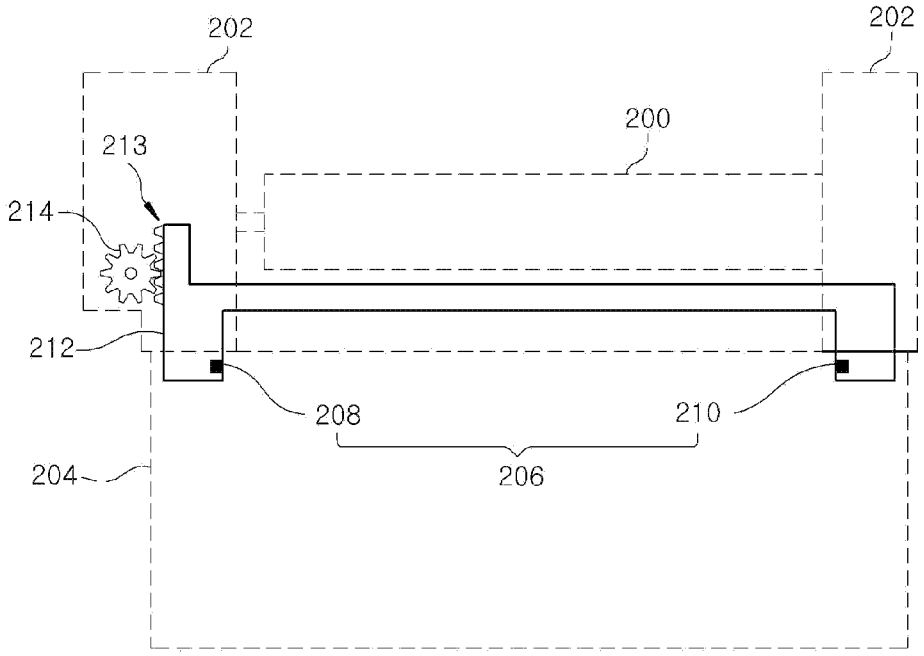
FIG. 2 shows a block diagram of a device for controlling a highest level of ice in accordance with an embodiment of the present invention.

FIG. 2 shows a block diagram of a device for adjusting a full-ice level in accordance with an embodiment of the present invention.

Referring to FIG. 2, the ice making tray 200 refers to a tray for loading water for making ice, and may be a tray where ice is made when a refrigerant is introduced through a refrigerant pipe (not shown) or cool air is direct at or along the tray.

The fixing unit for an ice making tray 202 refers to a member for supporting the ice making tray 200, positioned on both sides of the ice making tray 200.

The ice storage unit 204 is positioned below the ice making tray 200 to store the ice made in the ice making tray 200. When ice is made in the ice making tray 200, the ice formed in the ice making tray 200 may be separated from the ice making tray 200 by, for example, twisting the ice making tray 200 or scraping the inside of the ice making tray 200 by means of an ejector (not shown). The separated ice may drop into and stored in the ice storage unit 204 below the ice making tray 200.

The full-ice level sensor 206 is a device for measuring the amount of ice stored in the ice storage unit 204, and may include a light receiving unit 208 and a light emitting unit 210. The light emitting unit 210 emits light and the light emitted by the light emitting unit 210 is received by the light receiving unit 208. In this case, if the ice storage unit 204 is full of ice, then the ice stored in the ice storage unit 204 blocks the light, so that the light emitted by the light emitting unit 210 may not be received by the light receiving unit 208. In this case, the state of the ice storage unit 204 full of ice may be sensed, but the present invention is not so limited.

Figure 1:
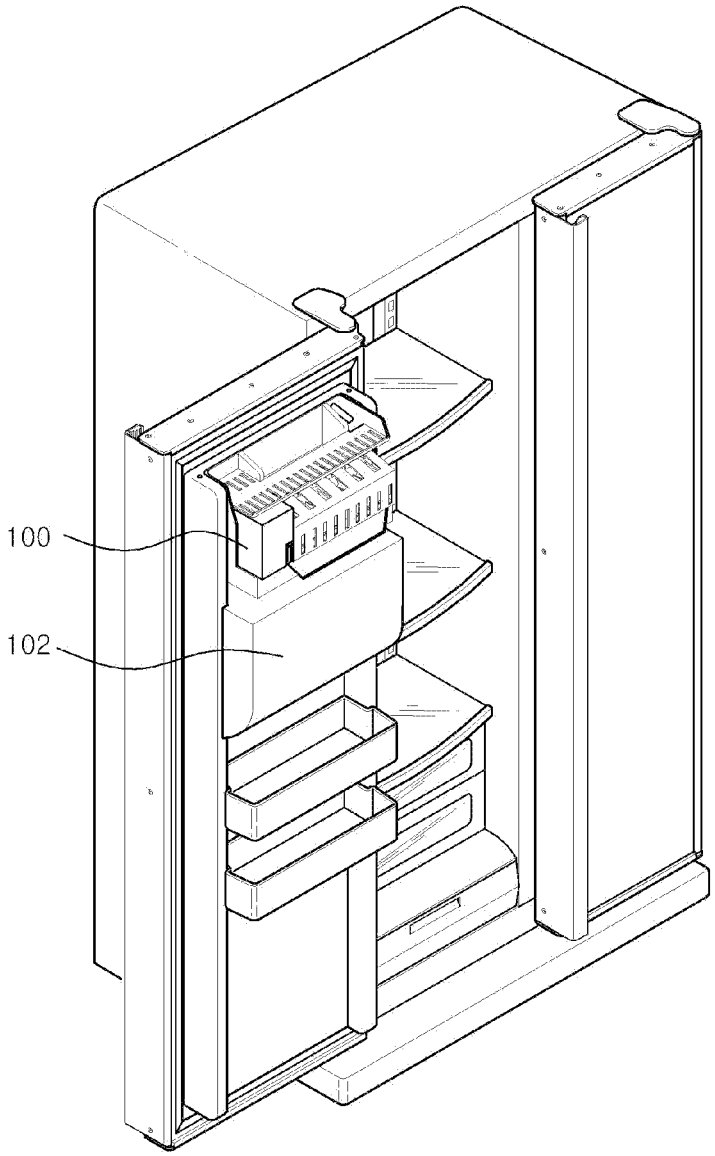
FIG. 1 (RELATED ART)
FIG. 1 shows an example of an ice maker installed in a freezer compartment of a refrigerator.

Meanwhile, as described above, a full-ice level sensor is typically fixed on a predetermined upper part of the ice storage unit as shown in FIG. 1, not allowing the amount of ice stored in the ice storage unit to be adjusted.

In contrast, the present invention enables the full-ice level sensor 206 to be capable of moving to a different position upward and downward in the ice storage unit 204 to respond to a user's position adjustment request to adjust the amount of ice stored in the ice storage unit 204.

In addition, in an embodiment, the sensor guide 212 equipped with the full-ice level sensor 206 for adjusting the position of the full-ice level sensor 206 is structured to move upward and downward in the ice storage unit 204 by means of a motor 214 as shown in FIG. 2.

That is, the sensor guide 212 is positioned horizontally on the upper part of the ice storage unit 204, with the light receiving unit 208 of the full-ice level sensor 206 on one side and the light emitting unit 210 of the full-ice level sensor 206 on the other side of the sensor guide. In addition, in an embodiment, the sensor guide 212 is coupled with the motor 214 located on the ice making tray fixing unit 202, and moves upward and downward in the ice storage unit 204 by driving the motor 214 to adjust the position of the full-ice level sensor 206.

In an embodiment, the sensor guide 212 is coupled with the motor 214 through the guide gear 213. The sensor guide 212 moves upward/downward in the ice storage unit 204 to adjust the position of the full-ice level sensor 206 by driving the guide gear 213 upward/downward with the motor 214, but the present invention is not so limited.

Figure 3:
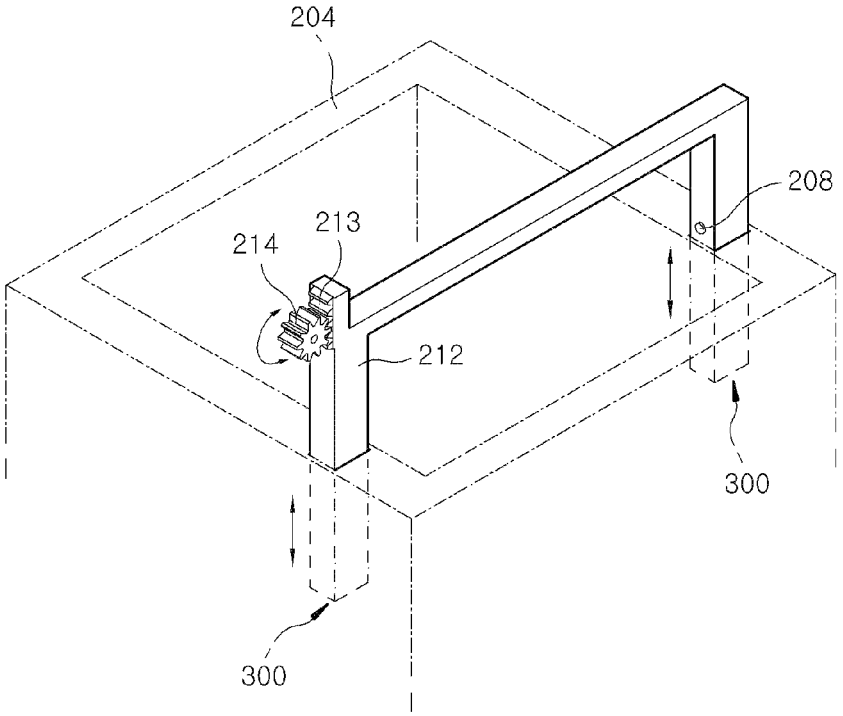
FIG. 3 is a perspective view of a sensor guide unit and an ice storage unit in accordance with an embodiment of the present invention.

In addition, the sensor guide 212 may move through the guide 300 located on the inner side of the ice storage unit 204 as shown in FIG. 3, to move upward/downward in and relative to the ice storage unit 204. The guide 300 may be coupled with, for example, the sensor guide 212 on both sides of the ice storage unit 204, but the present invention is not so limited.

The motor 214 may be located on one side of the ice making tray fixing unit 202 and coupled with the sensor guide 212 in a gear structure through the guide gear 213, and may transmit torque to and thus rotate the guide gear 213 to enable the sensor guide 212 to move upward/downward in the ice storage unit 204.

Figure 4:
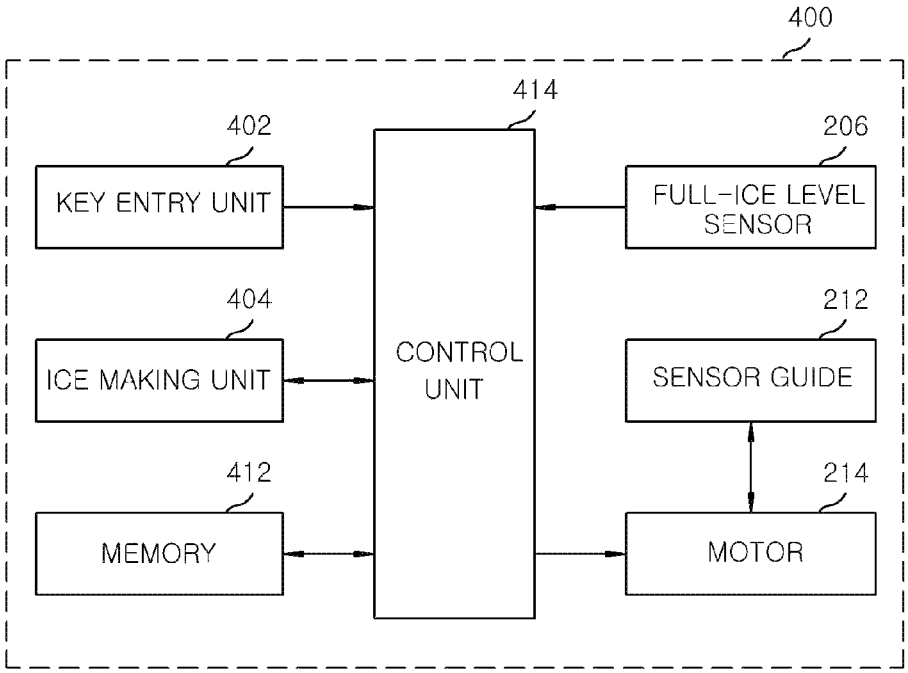
FIG. 4 shows a block diagram of an ice maker capable of adjusting the position of a full-ice level sensor in accordance with an embodiment of the present invention.

FIG. 4 shows a block diagram of an ice maker 400 capable of adjusting the position of a full-ice level sensor in accordance with an embodiment of the present invention. The ice maker may include a key entry unit 402, an ice making unit 404, a full-ice level sensor 206, a motor 214, a sensor guide 212, a memory 412, and a control unit 414.

Referring to FIG. 4, operation of each component of the ice maker 400 of the present embodiment of the present invention is described hereinafter in detail.

The key entry unit 402 may be configured to have a plurality of numeric keys or function keys for controlling or programming the ice maker 400. When a user presses a given key, the key entry unit produces corresponding key data and outputs the data to the control unit 414. In addition, the plurality of numeric keys or function keys equipped in the key entry unit 402 may be represented as a touch screen by software in place of a physical keypad.

The ice making unit 404 repeats the process of ice making in the ice making tray 200 and separation of ice from the ice making tray 200 under the control of the control unit 414 to automatically store the ice in the ice storage unit.

That is, the ice making unit 404 makes ice with the water loaded in the ice making tray 200 by supplying an amount of water pre-calculated to fill, in an embodiment, a plurality of divided portions in the ice making tray 200, as shown in FIG. 2. A refrigerant is supplied to a refrigerant pipe (not shown) positioned on the lower part of the ice making tray 200, or cold air is directly supplied to the upper part of the ice making tray 200, to make ice from the water in the ice making tray 200.

Subsequently, when the ice made in the ice making tray 200 is detected, in an embodiment, the ice making unit 404 twists the ice making tray 200 or, in another embodiment, drives an ejector for separating the ice from the ice making tray 200 in order to separate ice from the ice making tray 200. In this case, the ice separated as described above drops from the ice making tray 200 and is stored in the ice storage unit 204 installed below the ice making tray 200 and shown in FIG. 2.

Subsequently, the ice making unit 404 repeats the ice making process by supplying water to the ice making tray 200 when ice is removed from the ice making tray 200. The aforementioned ice making process continues until the full-ice level sensor 206 detects the full-ice level in the ice storage unit 204.

The full-ice level sensor 206 is a sensor for detecting the full-ice level of the ice storage unit 204, and may be installed on the sensor guide 212 positioned horizontally on the upper part of the ice storage unit 204 as shown in FIG. 2.

The full-ice level sensor 206 may be implemented as, for example, an optical sensor, that may include the light emitting unit 210 that emits light horizontally across the ice storage unit 204 from a predetermined position in the ice storage unit 204, and may also include the light receiving unit 208 that receives the light emitted by the light emitting unit 210, as shown in FIG. 2.

That is, the full-ice level sensor 206 provides the control unit 414 with information about whether the light emitting unit 210 emitted light from a predetermined position in the ice storage unit 204 and whether the light receiving unit 208 received the light emitted by the light emitting unit 210 under the control of the control unit 414. In this case, for example, if information provided to the control unit 414 indicates that the light emitted by the light emitting unit 210 is not being received by the light receiving unit 208, then the control unit 414 may decide that the light is blocked because the ice in the ice storage unit 204 has reached the top of the ice storage unit 204 and is at the full-ice level of the ice storage unit 204.

The motor 214 may be located on one side of the ice making tray fixing unit 202 that supports the ice making tray 200 as shown in FIG. 2, and operates when it is driven by the control unit 414. The motor 214 transmits rotational motion to a gear structure which moves the sensor guide 212.

More specifically, in an embodiment, the sensor guide 212 is coupled with the motor 214 by a gear structure including the guide gear 213 located on one side of the motor as shown in FIG. 2, and moves vertically upward/downward in the ice storage unit 204 using the motor 214 to adjust the position of the full-ice level sensor 206. In this case, the sensor guide 212 may move vertically upward/downward in the ice storage unit 204 because the guide gear 213 converts rotational motion from the motor 214 into vertical upward/downward motion when the motor 214 is operated.

The control unit 414 controls overall operation of the ice maker of the present invention in accordance with the operation program stored in the memory 412. That is, the control unit 414 uses the information detected by the full-ice level sensor 206 to control the ice making unit 404 to make ice until the full-ice level is reached, and automatically stores the ice in the ice storage unit 204.

In addition, when an input for adjusting the position of the full-ice level sensor 206 is received to thereby adjust the maximum amount of ice that is to be stored in the ice storage unit 204, an embodiment of the present invention is for calculating the amount of rotation of the motor 214 equivalent to the position adjustment input, rotating the motor 214 by the calculated amount, and correspondingly moving the sensor guide 212 equipped with the full-ice level sensor 206 to a specific position in the ice storage unit 204 to adjust the position of the full-ice level sensor 206.

In this case, to adjust the position of the full-ice level sensor 206, the control unit 414 may receive position information for the full-ice level sensor 206 established by a user through, for example, the key entry unit 402, to calculate the amount of rotation of the motor 214 to position the full-ice level sensor 206 in an appropriate position. In addition, while the step-by-step positions of the full-ice level sensor 206 are predetermined in the ice storage unit 204 and the amount of motor rotation is pre-calculated, it is possible to read the amount of rotation equivalent to the position selected by the user.

Figure 5:
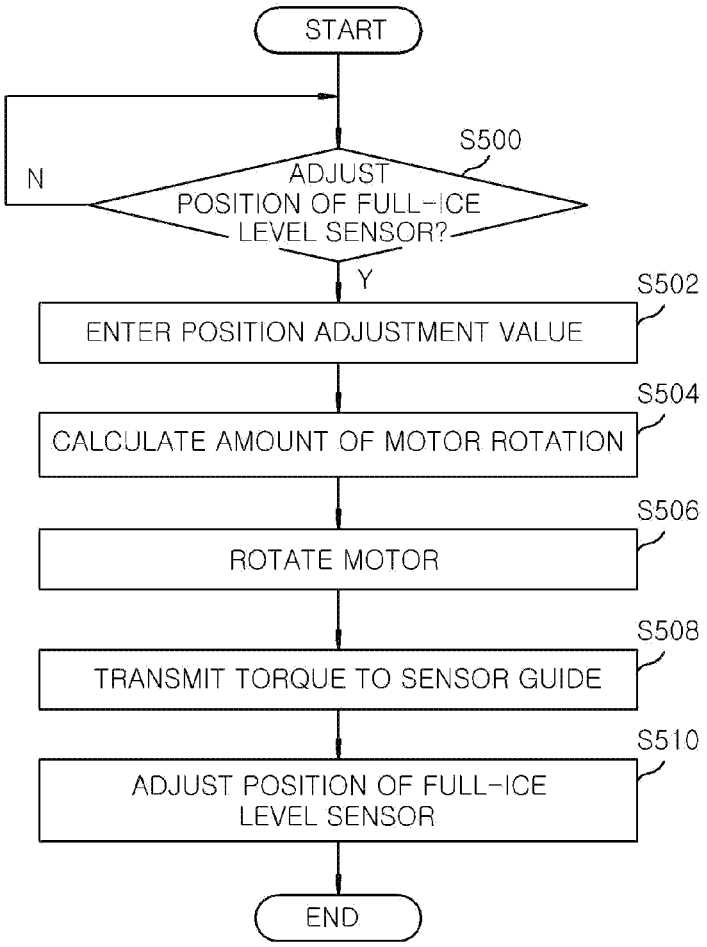
FIG. 5 shows a flow diagram of a method of adjusting the position of the full-ice level sensor in the ice maker in accordance with an embodiment of the present invention.

FIG. 5 shows a flow diagram of a method of adjusting the position of the full-ice level sensor in the ice maker in accordance with an embodiment of the present invention. Referring to FIGS. 2 to 5, the embodiment of the present invention will be described in detail hereinafter.

The user may carry out a key operation using the key entry unit 402 to request a position for the full-ice level sensor 206 be adjusted in order to reduce the amount of ice made by the ice maker 400 in a refrigerator.

The control unit 414 of the ice maker receives the position adjustment input for the full-ice level sensor 206 at operation S500, and a position adjustment value of the full-ice level sensor 206 entered through the key operation from the key entry unit 402 at operation S502. The position adjustment value may be entered using the key entry unit 402 through specific key entries or by combinations of multiple function keys that are programmed to select the position adjustment value for the full-ice level sensor 206, but the present invention is not so limited.

When a position adjustment value for the full-ice level sensor 206 is entered as described above, the control unit 414 calculates the amount of rotation of the motor 214 equivalent to the position adjustment value for the full-ice level sensor 206 at S504. In this case, the control unit 414 calculates the amount of rotation of the motor 214 equivalent to the position adjustment value as described below. That is, the control unit 414 may calculate the amount of rotation of the motor 214 required for upward/downward movement control of the sensor guide 212 while it already knows the upward/downward movement value of the sensor guide 212 depending on the amount of rotation of the motor 214, in accordance with the features of the present invention for moving upward/downward the sensor guide 212 equipped with the full-ice level sensor 206.

Subsequently, after calculating the amount of rotation of the motor 214, the control unit 414 drives the motor 214, and rotates the motor 214 by the calculated amount of rotation at S506. In this case, the torque occurring in conjunction with the rotation of the motor 214 is transmitted to the sensor guide 212 at S508. As a result, the sensor guide 212 moves upward or downward in the ice storage unit 204, by the amount equivalent to the transmitted torque, to adjust the position of the full-ice level sensor 206 at S510.

That is, the sensor guide 212 may move upward/downward in the ice storage unit 204 through the guide gear 213 that converts rotational motion of the motor 214 to vertical upward/downward motion when the motor 214 rotates, while the sensor guide 212 is coupled with the motor 214 in a gear structure through the guide gear 213 formed on one side thereof as shown in FIG. 2. As a result, since the position of the full-ice level sensor 206 equipped in the sensor guide 212 moves upward or downward in the ice storage unit 204, the position of the full-ice level sensor 206 is thus adjusted.

As described above, the ice maker for refrigerators in accordance with the present invention allows users to adjust the amount of ice depending on user's inclinations and the circumstances and reduce the amount of power consumed to make the ice by allowing users to selectively adjust the position of the full-ice level sensor to adjust the amount of ice according to the season, for example. For instance, in winter, there may be less demand for ice because users may consume relatively less ice made by the ice maker.

While the description of the present invention has been made to the example embodiments, various changes and modifications may be made without departing from the scope of the present invention. The embodiments of the present invention are not limited thereto. Therefore, the scope of the present invention should be defined by the appended claims rather than by the foregoing embodiments.

What is claimed is:

1. A device for adjusting an amount of ice to be made, the device comprising:

an ice making tray operable for making the ice;

an ice making tray fixing unit positioned on both sides of the ice making tray and supporting the ice making tray;

an ice storage unit positioned below the ice making tray and configured for storing the ice that is separated from the ice making tray;

an ice level sensor for detecting whether a highest level of the ice stored in the ice storage unit reaches a full-ice level for the ice storage unit;

a sensor guide on which the ice level sensor is installed, and positioned in the ice storage unit; and a motor located on one side of the ice making tray fixing unit and coupled with the sensor guide, and operable for moving the sensor guide upward and downward in the ice storage unit in order to adjust the full-ice level, wherein the ice level sensor includes a light emitting unit and a light receiving unit installed on opposite sides of the sensor guide to detect that the highest level of the ice reaches the full-ice level based on whether light emitted from the light emitting unit is received by the light receiving unit, and wherein the ice making tray stops making the ice when the highest level of the ice reaches the full-ice level.

2. The device of claim 1, wherein the sensor guide includes a guide gear that is coupled with the motor, and moves upward and downward in the ice storage unit in response to movement of the guide gear upward and downward driven by the motor.

3. The device of claim 1, wherein the ice storage unit has a guide formed therein, the guide enabling the sensor guide to move upward and downward relative to the ice storage unit.

4. The device of claim 3, wherein the guide is formed on two sides of the ice storage unit.

5. An ice maker capable of adjusting an amount of ice to be made, the ice maker comprising:

an ice making unit operable for repeating a process of making the ice and separating the ice from an ice making tray;

an ice level sensor for detecting whether a highest level of the ice in an ice storage unit reaches a full-ice level for the ice storage unit;

a sensor guide on which the ice level sensor is disposed, and positioned in the ice storage unit;

a motor coupled with the sensor guide via a gear structure, and operable for moving the sensor guide upward and downward in the ice storage unit according to the motor's rotation in order to adjust the full-ice level; and a control unit operable for controlling the process of making ice until the level of ice reaches the full-ice level, for calculating an amount of motor rotation equivalent to a position adjustment for the ice level sensor in response to a position adjustment input, and for driving the motor by the calculated amount of motor rotation to adjust the position of the ice level sensor, wherein the ice level sensor includes a light emitting unit and a light receiving unit installed on opposite sides of the sensor guide to detect that the highest level of the ice in the ice storage unit reaches the full-ice level based on whether light emitted from the light emitting unit is received by the light receiving unit, and wherein the ice making unit stops repeating the process when the highest level of the ice reaches the full-ice level.

6. The ice maker of claim 5, wherein the motor is disposed on one side of an ice making tray fixing unit that supports the ice making tray, and moves the sensor guide upward and downward in the ice storage unit when the motor is driven by the control unit.

7. The ice maker of claim 5, wherein the sensor guide is coupled with the motor through a guide gear of the gear structure that converts rotational motion of the motor into upward and downward motions of the sensor guide in the ice storage unit.

8. A refrigerator comprising the ice maker of claim 5.

9. A method for adjusting an amount of ice to be made by an ice making tray and stored in an ice storage unit, the method comprising:

receiving a position adjustment value for an ice level sensor in an ice maker;

calculating an amount of motor rotation corresponding to the position adjustment value for adjusting the position of a sensor guide on which the ice level sensor is disposed;

rotating the motor by the calculated amount of rotation; and moving the sensor guide upward and downward in the ice storage unit in response to the rotation of the motor to adjust the position of the ice level sensor in order to adjust a full-ice level for the ice storage unit, wherein the ice level sensor includes a light emitting unit and a light receiving unit installed on opposite sides of the sensor guide to detect that a highest level of the ice in the ice storage unit reaches the full-ice level based on whether light emitted from the light emitting unit is received by the light receiving unit, and wherein making the ice by the ice making tray is stopped when the highest level of the ice reaches the full-ice level.

10. The method of claim 9, wherein the sensor guide comprises a guide gear coupled with the motor, and the sensor guide is moved upward and downward in the ice storage unit by driving the guide gear according to the motor's rotation.

11. The method of claim 10, wherein the sensor guide moves upward and downward in the ice storage unit along a guide in the ice storage unit.

* * * * *